US008911313B2

(12) United States Patent
Schmid et al.

(10) Patent No.: US 8,911,313 B2
(45) Date of Patent: Dec. 16, 2014

(54) METHOD FOR THE PRODUCTION OF A ONE-PIECE METALLIC MULTIPLE WHEEL, PREFORM FOR THE PRODUCTION THEREOF, AND MULTIPLE WHEEL

(75) Inventors: Herbert Schmid, Vorchdorf (AT); Wolfgang Siessl, Traunkirchen (AT); Karl Dickinger, Vorchdorf (AT)

(73) Assignee: Miba Sinter Austria GmbH (AT)

( * ) Notice: Subject to any disclaimer, the term of this patent is extended or adjusted under 35 U.S.C. 154(b) by 1142 days.

(21) Appl. No.: 12/447,046

(22) PCT Filed: Oct. 22, 2007

(86) PCT No.: PCT/AT2007/000489

§ 371 (c)(1),
(2), (4) Date: Jul. 26, 2010

(87) PCT Pub. No.: WO2008/049145

PCT Pub. Date: May 2, 2008

(65) Prior Publication Data

US 2010/0279807 A1 Nov. 4, 2010

(30) Foreign Application Priority Data

Oct. 24, 2006 (AT) ..... A 1779/2006

(51) Int. Cl.

| | |
|---|---|
| ***F16H 55/17*** | (2006.01) |
| ***F16H 55/30*** | (2006.01) |
| ***B21D 53/28*** | (2006.01) |
| ***B21H 5/00*** | (2006.01) |
| ***B21H 5/02*** | (2006.01) |
| ***B22F 5/08*** | (2006.01) |

(52) U.S. Cl.
CPC . *B21H 5/022* (2013.01); *B22F 5/08* (2013.01)
USPC ..... 474/160

(58) Field of Classification Search
USPC ..... 474/160; 74/457, 462; 428/579, 548; 29/893
See application file for complete search history.

(56) References Cited

U.S. PATENT DOCUMENTS 3,580,029 A * 5/1971 Daniel et al. ..... 72/108
3,867,751 A * 2/1975 Connell et al. ..... 419/28

(Continued)

FOREIGN PATENT DOCUMENTS

CN 2111154 U 7/1992
CN 1319467 C 10/2001

(Continued)

OTHER PUBLICATIONS

International Search Report, PCT/AT2007/000489.

(Continued)

*Primary Examiner* — William E Dondero
*Assistant Examiner* — Mark K Buse
(74) *Attorney, Agent, or Firm* — Lerner, David, Littenberg, Krumholz & Mentlik, LLP

(57) ABSTRACT

The invention relates to a method for the production of a one-piece, metal multiple wheel (2) for a traction mechanism comprising at least two adjacently disposed single wheels (3, 4), each comprising a wheel body (5, 6) having an outer circumference (7, 8), wherein teeth (9, 10) for engaging the traction mechanism are arranged in a distributed manner over the outer circumference (7, 8), and wherein at least one of the two single wheels (3, 4) is configured as a sprocket, gear or toothed belt wheel. The sprocket, gear or toothed belt wheel is produced with a rough contour, wherein a tooth thickness of the rough contour (17), in axial view, is greater than the tooth thickness of the final contour of the finished sprocket, gear or toothed belt wheel and thereafter depending on the traction means used, this rough contour is reformed by non-machining reforming, in particular by rolling, into the finished tooth contour, wherein a toothed belt wheel contour is produced from a sprocket wheel or gear wheel contour or a sprocket wheel contour is produced from a gear wheel or toothed belt wheel contour, or a gear wheel contour is produced from a toothed belt or sprocket wheel. The invention further relates to a preform for producing multiple wheel and to a multiple wheel.

8 Claims, 2 Drawing Sheets

(56) References Cited

U.S. PATENT DOCUMENTS

| | | | | |
|---|---|---|---|---|
| 3,874,049 | A * | 4/1975 | Ferguson | 419/28 |
| 4,708,912 | A * | 11/1987 | Huppmann | 428/547 |
| 5,884,527 | A * | 3/1999 | Cole et al. | 74/434 |
| 5,903,815 | A * | 5/1999 | Scott | 428/564 |
| 6,134,786 | A * | 10/2000 | Graupner et al. | 29/893.35 |
| 6,250,123 | B1 * | 6/2001 | Killop | 72/88 |
| 6,348,001 | B2 | 2/2002 | Killop | |
| 6,401,562 | B1 * | 6/2002 | De' Stefani | 74/462 |
| 6,592,809 | B1 * | 7/2003 | Anderson et al. | 419/28 |
| 7,137,312 | B2 * | 11/2006 | Cole | 74/462 |
| 7,556,864 | B2 * | 7/2009 | Yamanishi et al. | 428/602 |
| 2004/0016123 | A1 * | 1/2004 | Sandner | 29/893 |
| 2004/0221453 | A1 * | 11/2004 | Cole | 29/893.32 |
| 2008/0246266 | A1 * | 10/2008 | Oesterle et al. | 280/805 |

FOREIGN PATENT DOCUMENTS

| | | | |
|---|---|---|---|
| CN | 1644266 | A | 7/2005 |
| DE | 255492 | | 4/1988 |
| DE | 10216524 | | 11/2003 |
| DE | 10357979 | | 7/2005 |
| EP | 1063032 | | 12/2000 |
| EP | 1084775 | | 3/2001 |
| EP | 1268102 | | 1/2003 |
| WO | 9205897 | | 4/1992 |
| WO | 0174514 | | 10/2001 |

OTHER PUBLICATIONS

Office Action from corresponding Austrian Application A 1779/2006, dated Jun. 29, 2007.

* cited by examiner

METHOD FOR THE PRODUCTION OF A ONE-PIECE METALLIC MULTIPLE WHEEL, PREFORM FOR THE PRODUCTION THEREOF, AND MULTIPLE WHEEL

CROSS REFERENCE TO RELATED APPLICATIONS

The present application is a national phase entry under 35 U.S.C. §371 of International Application No. PCT/AT2007/000489, filed Oct. 22, 2007, which claims the benefit of Austrian Patent Application No. A 1779/2006, filed Oct. 24, 2006. The disclosures of the above applications are incorporated by reference herein.

The invention relates to a method for the production of a one-piece, metal multiple wheel for a traction mechanism comprising at least two adjacently disposed single wheels, each comprising a wheel body having an outer circumference, wherein teeth for engaging the traction mechanism are arranged in a distributed manner over the outer circumference, and wherein at least one of the two wheels is configured as a sprocket, gear or toothed belt wheel, as well as a preform for producing a one-piece, metal multiple wheel and a one-piece, metal multiple wheel.

Multiple sprocket wheels are already known from the prior art. Thus, for example, DE 102 16 524 A describes a chain drive comprising two drive chains disposed adjacently to one another and over multiple sprocket wheels. Such multiple sprocket wheels are either configured as multi-piece, wherein a plurality of single sprocket wheels are connected to one another, but also as one-piece, wherein a wheel body comprises a plurality of single wheels having corresponding toothed structures on the outer circumferences. The tooth geometry is fixed in the manufacturing method both in the one-piece and in the multi-piece variant. It is therefore necessary to keep in stock corresponding moulds and tools for each multiple sprocket wheel having the special tooth geometry in each case.

It is the object of the present invention to provide a possibility for configuring the production of multiple wheels for a traction mechanism in a more variable manner.

This object of the invention is achieved independently in each case by producing the sprocket, gear or toothed belt wheel having a rough contour 17 in the method according to the invention, wherein the tooth thickness of the rough contour, in axial view, is greater than the tooth thickness of the final contour of the finished sprocket, gear or toothed belt wheel and thereafter depending on the traction means used, this rough contour is reformed by non-machining reforming, in particular by rolling, into the finished tooth contour, wherein a toothed belt wheel contour is produced from a sprocket wheel or gear wheel contour, a sprocket wheel contour is produced from a gear wheel or toothed belt wheel contour, or a gear wheel contour is produced from a toothed belt or sprocket wheel, by means of a pre-form corresponding to these features and used in this method for producing a one-piece metal multiple wheel for a traction device and by means of a one-piece metal multiple wheel for a traction drive itself, in which the at least one of the two single wheels is produced by non-machining reforming, in particular by rolling from a rough contour for a sprocket, gear or toothed belt wheel, wherein a toothed belt wheel contour is produced from a sprocket wheel or gear wheel contour, a sprocket wheel contour is produced from a gear wheel or toothed belt wheel contour, or a gear wheel contour is formed from a toothed belt or sprocket wheel.

With the aid of the invention, the respectively desired wheel, for example, gear wheel, sprocket wheel or toothed belt wheel can be produced from a preform depending on the intended traction means, so that it is possible to prefabricate corresponding preforms regardless of the ultimate tooth geometry, with the result that it is possible to respond more rapidly to customer requirements since only the corresponding reforming into the ultimate tooth geometry is necessary. It is therefore possible to produce these preforms for stock so that production bottlenecks can be evened out by corresponding preproduction at times of lower usage of capacity. The invention can therefore be seen in that either the finished tooth contour of the sprocket or gear wheel or the finished tooth contour of a toothed belt wheel is produced from the rough contours. Due to the non-machining reforming, in particular rolling, it is additionally achieved that the material wastage can be significantly reduced compared with conventional production methods in which the tooth geometry has been produced from the original form by machining. In addition, multiple wheels which cannot be produced by normal sintering methods or only with considerably higher expenditure, can also be produced relatively simply, for example, a triple wheel in which the middle single wheel has a smaller diameter than the two peripheral single wheels.

According to one embodiment of the method, the tooth height can be reduced before the reforming so that the variability of the tooth contour to be fixed can be increased. It is therefore possible to respond better to different diameters of single wheels.

According to one embodiment of the preform according to the invention, it is provided that the rough contour of the teeth is configured at least approximately as evolvent-like, with the result that the non-machining reforming, that is the expulsion of material, can be made easier. A lower degree of wear of the reforming tools or reforming machines can also be achieved.

The preform can furthermore consist of a sintered metal or a sintered metal alloy. Since these components have a more or less high porosity after sintering, it is advantageous that the reforming can be made easier since the porosity is reduced in the outer zone, that is the component is compacted in these zones. Due to the higher density in the outer zone of the component, a better wear resistance can additionally be achieved. In addition, a smoothing of the surface or a better surface quality is thereby also achieved, for example, the teeth have no transverse striae such as those normally produced during the pressing of a sintered metal powder due to the process.

For a better understanding of the invention, this is explained in detail with reference to the following figures.

In the figures, in each case in a simplified schematic representation:

Figure 1:
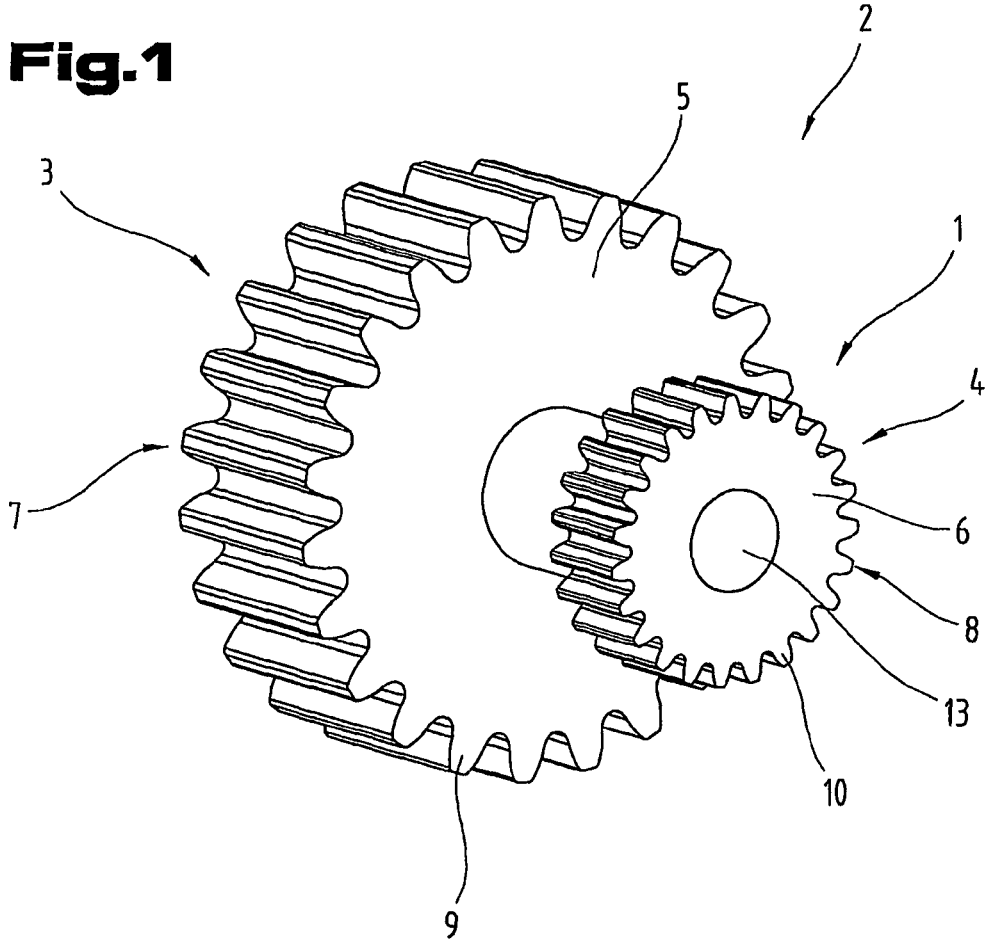
FIG. 1 shows one embodiment of the preform as a double wheel in oblique view.

It should first be noted that in the variously described embodiments, the same parts are provided with the same reference numerals or the same component designations, wherein the disclosures contained in the entire description can accordingly be applied to the same parts with the same reference numerals or the same component designations. The positional information selected in the description, such as, for example, above, below, at the side, etc. is related to the figure being directly described or depicted and in the event of a change in position, can be applied accordingly to the new position. Individual features or combinations of features from the different exemplary embodiments shown and described can also constitute independent, inventive solutions or solutions according to the invention per se.

All information on ranges of values in the present description are to be understood such that these include any and all partial ranges thereof, for example, the specification 1 to 10 should be understood such that all partial ranges starting from the lower limit 1 and the upper limit 10 are included, i.e. all partial ranges begin with a lower limit of 1 or higher and end at an upper limit of 10 or less, e.g. 1 to 1.7 or 3.2 to 8.1 or 5.5 to 10.

Figure 2:
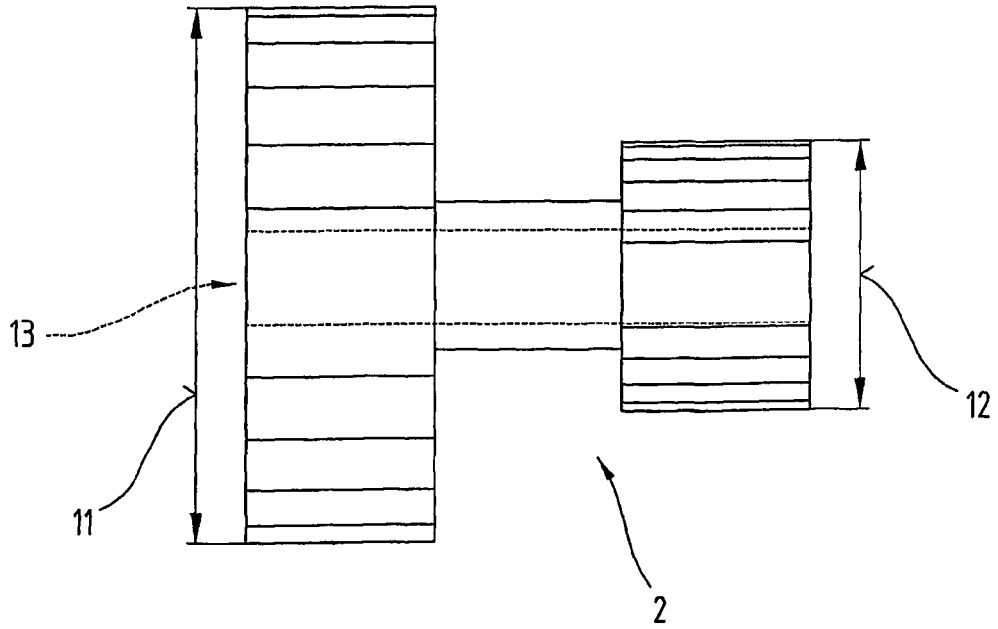
FIG. 2 shows the preform from FIG. 1 in front view.

FIGS. 1 and 2 show a preform 1 for producing a multiple wheel 2 for a traction mechanism. Such traction mechanisms are, for example, chain drives or belt drives (toothed belt drive).

The multiple wheel 2 produced from the preform 1 according to FIG. 1 comprises two single wheels 3, 4. Each of these single wheels 3, 4 comprises a wheel body 5, 6 having an outer circumference 7, 8 over which teeth 9, 10 for engaging the traction means are arranged in a distributed manner.

In this embodiment of the multiple wheel 2, the two single wheels 3, 4 have a different diameter 11, 12 (FIG. 2). Naturally it is possible that the two single wheels 3, 4 have the same diameter 11, 12.

It is furthermore possible that the multiple wheel 2 not only has two single wheels 3, 4 but also more that more than two, for example, 3, 4, 5 etc. multiple wheels 3, 4 are provided. At the same time, it is possible that these single wheels 3, 4 have a different diameter or all the single wheels 3, 4 have the same diameter or more than two. In preferred embodiments the multiple wheel 2 has three single wheels 3, 4 with decreasing diameter 11, 12, wherein the teeth 9 of the single wheel 3 having the largest diameter 11 and the optionally adjoining single wheel are configured for a chain drive and the smallest single wheel 4 is configured for engagement of a toothed belt.

As is apparent from FIGS. 1 and 2, the multiple wheel 2 has a central hole 13 for receiving a shaft or the like.

In the preferred embodiment the multiple wheel 2 or the preform 1 is formed from a sintered metal or a sintered metal alloy. These can be formed, for example, from an aluminium, iron, copper, magnesium basis. Examples of such sintered metal alloys can be obtained from DIN V 30 910 Part 4, page 3.

Since the person skilled in the art is familiar with the fundamental manufacture of sintered components, reference is made to the relevant literature at this point. In particular, the production of sintered components comprises the steps of mixing the powder, optionally with additives or adjuvants, compacting the powder to form a green compact, sintering the green compact, optionally calibrating and/or post-compacting the sintered component.

Figure 3:
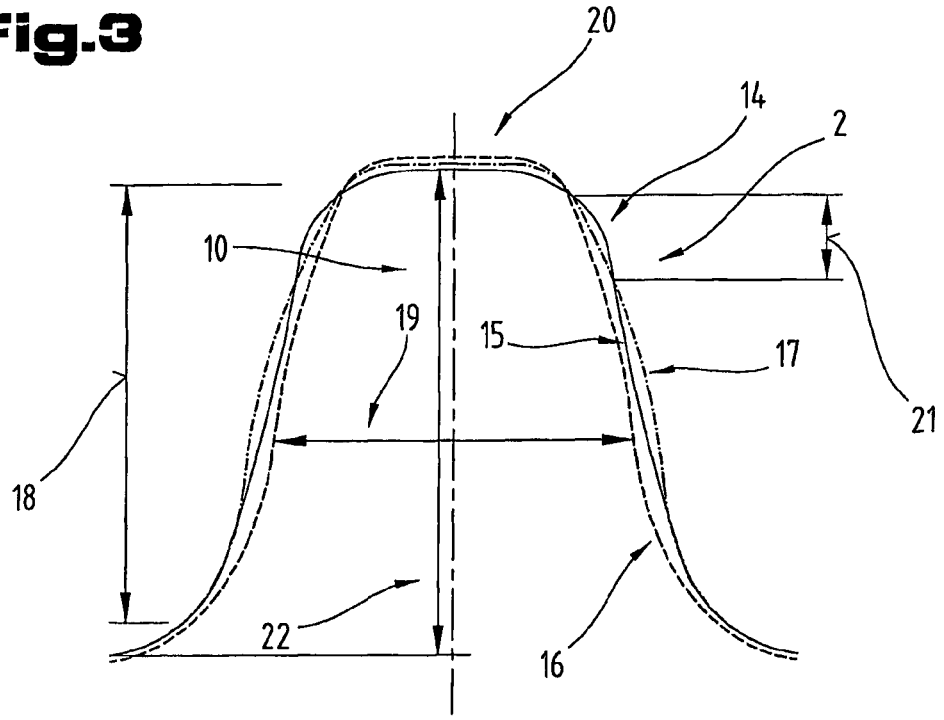
FIG. 3 shows a first embodiment of the teeth reforming.

FIG. 3 shows a first embodiment for the reforming and final manufacture of the tooth contour for the multiple wheel 2. For this purpose only one tooth 10 is shown in FIG. 3. In particular, its tooth contour 14 is shown as a contour for a toothed belt, subsequently called toothed belt wheel contour 15, as a contour for a toothed chain, subsequently called sprocket wheel contour 16 (dashed line) and as a rough contour 17 (dot-dash line). The rough contour 17 is preferably produced as rough contour 17 for producing teeth 10 for engagement of a toothed chain. In particular, this is the rough contour 17 after sintering the respective preform 1.

As is apparent from FIG. 3, this rough contour 17 of the tooth 10 in the area of a tooth flank 18 is thicker than a tooth flank thickness 19 of the finished tooth 10 for engagement of a toothed chain. A non-machining reforming is carried out for the final production of the tooth 10 from this rough contour 17, whereby the material is brought at least partially from the area of the excess dimension of the tooth flank 18 into a tooth head region 20. At the same time, a compaction of the sintered material in the circumferential area of the tooth 10 can take place during this reforming.

In order to manufacture a tooth 10 for engagement of a toothed belt (toothed belt wheel contour 15) from this rough contour 17, the reforming is configured in such a manner that at least a part of the excess material of the rough contour 17 in the area of the tooth flank 18 is again moved in the direction of the tooth head region 20 but, since the teeth 10 for engagement of a toothed belt appear fundamentally different from the teeth 10 for engagement of a toothed chain, during this reforming the tooth flank region 21 adjoining the tooth head region 20 is broadened compared with the rough contour 17 and optionally material is also moved from the tooth head region 20 in this tooth flank region 21 so that a tooth height 22 is smaller than the tooth height of the rough contour 17. In the tooth neck region the toothed belt wheel contour 15 can overlap with the rough contour 17 of the tooth 10.

It may be mentioned at this point that the embodiment shown merely has an exemplary character so that the ultimate tooth geometry can be completely different from that shown. In this respect, FIG. 3 is merely intended to show a representation of the principle of manufacturing the multiple wheel 2 from the preform 1 (FIG. 1).

In the variant according to FIG. 3, the rough contour 17 is configured as approximately evolvent-like, resulting in the advantage that sufficient material is available for the reforming and/or compaction in order to produce a tooth 10 for a tooth chain or a toothed belt therefrom, as required. The maximum dimension of the excess width in the area of the tooth flank 18 can in this case have a value (in each case left or right excess dimension) selected from a range having an upper limit of a maximum of 25% relative to the tooth flank thickness 19 of the chain wheel contour tour 16 of the tooth 10. This upper limit should be understood in such a manner that the excess dimension is variable over the height of the tooth flank 18 and can be determined according to the respectively desired tooth geometry. Naturally, the excess dimension for relatively slim small teeth 10 is different from that for thicker larger teeth 10. In comparison, over the entire tooth geometry of the finished tooth 10, the excess dimension can fluctuate in the range of −25% to +25%, in particular −20% to +20%, as is apparent in outline from FIG. 3.

Although in this embodiment the preform 1 is configured symmetrically in regard to the tooth geometry, it is also possible that the extent of the excess dimension of the rough contour 17 in relation to the sprocket wheel contour 16 on the left tooth flank is different from the right tooth flank.

In this variant, the single wheel 3 is configured as a sprocket wheel but can also be a gear wheel. This single wheel preferably already has its final form before the reforming of the teeth 10 of the second single wheel 4.

Figure 4:
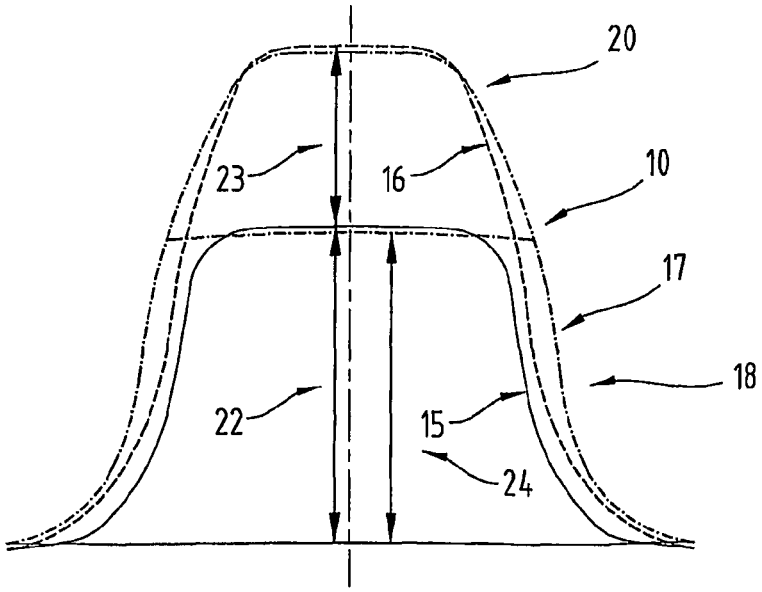
FIG. 4 shows a further embodiment of the teeth reforming.

FIG. 4 shows an embodiment of the invention in which the tooth 10 of the toothed belt wheel contour 15 (continuous lines) has a significantly lower tooth height 22 compared to the tooth 10 of the sprocket wheel contour 16 (dashed line). In order to make this difference 23 possible (for example, the tooth 10 of the toothed belt wheel contour 15 can have a tooth height 22 which is half the tooth height 22 of the sprocket wheel contour 16), a part of the tooth 10 is removed by machining in the tooth head region 20 since such a large reduction cannot be accomplished merely by reforming. The removal of the material of the tooth 10 follows, for example by turning to a tooth height 24 of the rough contour 17 (dot-dash line). Compared to the embodiment according to FIG. 3, after reforming the tooth 10 of the toothed belt wheel contour 15 produced by reforming has a greater tooth height 22 than the tooth height 24 of the rough contour 17, therefore more material is removed than would be necessary merely due to the tooth height. This has the result that the material can be moved from the area of the tooth flank 18 into the area of the tooth head by means of the reforming.

It is apparent both from FIG. 3 and from FIG. 4 that the steepness of the tooth flank and the area of the tooth head can be varied according to the reforming (steep tooth flank and broader tooth head for toothed belt drive compared to toothed chain drive).

The reforming itself is effected plastically, in particular by rolling. On the other hand, it is also possible to carry out the reforming by means of split dies, whereby pressure is applied laterally to the corresponding rough contour 17 via the split die and thus, material is expelled into the corresponding area. The reforming itself can be carried out both as hot reforming and as cold reforming.

With the aid of the method according to the invention, it is therefore possible to provide preforms 2 from which a multiple wheel 1 having at least one gear, toothed belt or sprocket wheel can be produced as required, the latter being produced by non-machining reforming from the preform 2. Thus, a toothed belt wheel can be produced from a contour for a gear or sprocket wheel, a sprocket wheel can be produced from a contour for a toothed belt or a gear wheel or a gear wheel can be produced from a contour for a toothed belt or a sprocket wheel, wherein as required the rough contour of the preform 2 can also be finally manufactured by non-machining treatment into the respective final profile for the originally intended teeth 9, 10, that is a gear wheel can be produced from the preform 2 for a gear wheel, a sprocket wheel can be produced from the preform 2 for a sprocket wheel or a toothed belt wheel can be produced from the preform 2 for a toothed belt wheel.

The exemplary embodiments show a possible variant of the method or the preform 1, wherein it should be noted at this point that the invention is not restricted to the embodiments of the same which are specially depicted but on the contrary, various combinations of the individual embodiments described with one another are possible and as a result of the teaching on the technical action by the present invention, this possibility of variation lies within the ability of the person skilled in the art working in this field. All feasible embodiments which are possible through combinations of individual details of the embodiment described are therefore covered by the scope of protection.

As a matter of form, it should finally be noted that for a better understanding of the structure of the preform 1 this or the components thereof were represented in part not to scale and/or enlarged and/or reduced in size.

The object forming the basis of the independent inventive solutions can be obtained from the description.

In particular, the individual embodiments shown in FIGS. 1, 2; 3, 4 can form the subject matter of independent solutions according to the invention. The related objects and solutions according to the invention can be deduced from detailed descriptions of these figures.

LIST OF REFERENCE NUMBERS

1 Preform
2 Multiple wheel
3 Single wheel
4 Single wheel
5 Wheel body
6 Wheel body
7 Circumference
8 Circumference
9 Tooth
10 Tooth
11 Diameter
12 Diameter
13 Hole
14 Tooth contour
15 Toothed belt wheel contour
16 Sprocket wheel contour
17 Rough contour
18 Tooth flank
19 Tooth flank thickness
20 Tooth head region
21 Tooth flank region
22 Tooth height
23 Difference
24 Tooth height

The invention claimed is:

1. A method for the production of a one-piece, multiple wheel for a traction mechanism from a metal material comprising:

configuring at least one of at least two adjacently disposed single wheels as a finished sprocket wheel, a finished gear wheel, or a finished toothed belt wheel, each wheel comprising a wheel body, an outer circumference, and teeth with different geometry for engaging the traction mechanism arranged in a distributed manner over the outer circumference; and producing the finished sprocket wheel, the finished gear wheel, or the finished toothed belt wheel from a preform for a sprocket wheel contour, a gear wheel contour or a toothed belt wheel contour, the preform having a rough contour configured in at least approximately an evolvent shape, and a tooth thickness of the rough contour, in axial view, is greater than a tooth thickness of a final contour of the finished sprocket wheel, the finished gear wheel, or the finished toothed belt wheel;

wherein the producing includes at least reforming the rough contour of the preform by non-machining reforming, the non-machining reforming comprises rolling, such that the metal material of the preform is brought at least partially from an area of excess dimension of a tooth flank into a tooth head region;

wherein a maximum dimension of an excess width in the area of excess dimension of the tooth flank can have a value selected from a range having an upper limit of 25% relative to the tooth thickness of the final contour;

wherein the finished toothed belt wheel can be produced from the preform for the sprocket wheel contour, the gear wheel contour, or the toothed belt wheel contour;

wherein the finished sprocket wheel can be produced from the preform for the gear wheel contour, the toothed belt wheel contour, or the sprocket wheel contour;

wherein the finished gear wheel can be produced from the preform for the toothed belt wheel contour, the sprocket wheel contour, or the gear wheel contour.

2. The method according to claim 1, wherein a tooth height is reduced prior to the reforming.

3. The method according to claim 1, wherein over the entire tooth geometry of the final contour, the area of excess dimension of the tooth flank fluctuates in the range of −20% to 20%, compared with the final contour.

4. A preform for a sprocket wheel contour, a gear wheel contour or a toothed belt wheel contour to produce a one-piece, multiple wheel for a traction mechanism from a metal material comprising at least one of at least two adjacently disposed single wheels configured as a finished sprocket wheel, a finished gear wheel, or a finished toothed belt wheel, each wheel comprising a wheel body, an outer circumference, and teeth with different geometry for engaging the traction mechanism arranged in a distributed manner over the outer circumference, wherein the preform has a rough contour configured in at least approximately an evolvent shape, and a tooth thickness of the rough contour, in axial view, is greater than a tooth thickness of a final tooth contour of the finished sprocket wheel, and wherein the metal material of the preform is brought at least partially from an area of an excess dimension of a tooth flank into a tooth head region and a maximum dimension of an excess width in the area of excess dimension of the tooth flank can have a value selected from a range having an upper limit of 25% relative to the tooth thickness of the final contour.

5. The preform according to claim 4, wherein the preform comprises a sintered metal or a sintered metal alloy.

6. The preform according to claim 4, wherein over the entire tooth geometry of the final contour, the area of excess dimension of the tooth flank fluctuates in the range of −20% to 20%, compared with the final contour.

7. A one-piece, multiple wheel for a traction mechanism from a metal material comprising at least one of at least two adjacently disposed single wheels configured as a finished sprocket wheel, a finished gear wheel, or a finished tooth belt wheel, each wheel comprising a wheel body, an outer circumference, and teeth with different geometry for engaging the traction mechanism are arranged in a distributed manner over the outer circumference, wherein the teeth geometry of the finished sprocket wheel, the finished gear wheel, and the finished toothed belt wheel have different teeth geometry, such that the two single wheels are configured for engaging different traction means, wherein at least one of the two single wheels is produced by non-machining reforming, the non-machining reforming comprising rolling, from a preform for a sprocket wheel contour, a gear wheel contour, or a toothed belt wheel contour, the preform having a rough contour configured in at least approximately an evolvent shape, and a tooth thickness of the rough contour, in axial view, is greater than a tooth thickness of a final contour of the finished sprocket, the finished gear wheel, or the finished toothed belt wheel, and wherein the finished toothed belt wheel can be produced from the preform for the sprocket wheel contour, the gear wheel contour, or the toothed belt wheel contour, further wherein the finished sprocket wheel can be produced from the preform for the gear wheel contour, the toothed belt wheel contour, or the sprocket wheel contour, further wherein the finished gear wheel can be produced from the preform for the toothed belt wheel contour, the sprocket wheel contour, or the gear wheel contour, whereby the metal material of the preform is brought at least partially from an area of an excess dimension of a tooth flank into a tooth head region, and a maximum dimension of an excess width in the area of excess dimension of the tooth flank can have a value selected from a range having an upper limit of 25% relative to the tooth thickness of the final contour.

8. The wheel according to claim 7, wherein over the entire tooth geometry of the final contour, the area of excess dimension of the tooth flank fluctuates in the range of −20% to 20%, compared with the final contour.

* * * * *